US005884686A

United States Patent [19]

Wood

[11] Patent Number: 5,884,686

[45] Date of Patent: Mar. 23, 1999

[54] CAST NODES AND PATTERNS FOR THEIR PRODUCTION

[75] Inventor: Anthony Wood, Yorkshire, England

[73] Assignee: River Don Castings Limited, Sheffield Yorkshire, England

[21] Appl. No.: 897,383

[22] PCT Filed: May 5, 1993

[86] PCT No.: PCT/GB93/00925

§ 371 Date: Mar. 20, 1995

§ 102(e) Date: Mar. 20, 1995

[87] PCT Pub. No.: WO93/22083

PCT Pub. Date: Nov. 11, 1993

Related U.S. Application Data

[63] Continuation of Ser. No. 594,377, Jan. 30, 1996, abandoned, which is a continuation of Ser. No. 335,730, Mar. 20, 1995, filed as PCT/GB93/00925, May 5, 1993 published as WO93/22083, Nov. 11, 1993, abandoned.

[30] Foreign Application Priority Data

May 7, 1992 [GB] United Kingdom ..... 9209848

[51] Int. Cl.[6] ..... B22C 7/00

[52] U.S. Cl. ..... 164/235; 164/45; 164/249

[58] Field of Search ..... 164/45, 235, 249

[56] References Cited

U.S. PATENT DOCUMENTS

| | | | |
|---|---|---|---|
| 3,461,635 | 8/1969 | Hugues . | |
| 4,115,975 | 9/1978 | Bliss | 52/648 |
| 4,790,172 | 12/1988 | Simensen et al. | 72/368 |
| 5,144,830 | 9/1992 | Ferrotti et al. | 72/356 |

FOREIGN PATENT DOCUMENTS

| | | | |
|---|---|---|---|
| 2 309 749 | 11/1976 | France . | |
| 63-248543 | 10/1988 | Japan | 164/45 |
| 64-44242 | 2/1989 | Japan | 164/45 |
| 2216831 | 10/1989 | United Kingdom | 164/45 |

*Primary Examiner*—Patrick Ryan
*Assistant Examiner*—I.-H. Lin
*Attorney, Agent, or Firm*—Kinney & Lange, P.A.

[57] ABSTRACT

A pattern from which cast nodes can be produced, the pattern including a central ring or disc against which one or more stubs abut at selected stations to enable nodes of differing annular geometries and/or stub diameter to be produced from the same pattern.

3 Claims, 1 Drawing Sheet

CAST NODES AND PATTERNS FOR THEIR PRODUCTION

This is a Continuation of application Ser. No. 08/594,377, filed Jan. 30, 1996 and now abandoned, which is a Continuation of application Ser. No. 08/335,730, filed Mar. 20, 1995, filed as PCT/GB93/00925, May 5, 1993, published as WO93/22083, Nov. 11, 1993, and now abandoned.

BACKGROUND OF THE INVENTION

This invention relates to nodes.

Steel node structures are conventionally formed with welded plate node points typically at the intersection of tubular or box members. Cast steel nodes have been developed to improve the performance of such node points in relation to stress flow and fatigue during use.

One object of this invention is to reduce the cost and weight of such nodes by minimising the size of the node and by making savings in pattern making costs. Nodes in accordance with the invention are one piece castings whose stubs are formed onto a central ring or disc.

According to the present invention in one aspect, there is provided a pattern from which a node can be cast as a single integral piece, the pattern being characterised in that it includes a central ring or disc against which one or more stubs abut at selected stations to enable nodes of differing angular geometries and/or stub diameters to be produced from the same pattern.

The axis of the ring or disc is generally, but not always normal to the axes of the main stubs. The ring or disc is preferably of circular form, other configurations may, however, be employed. The presence of the ring or disc also allows the adoption of standardised pattern equipment in which stub pattern pieces may be positioned at selected stations around the circumference of the central ring to allow for differences in stub spacings and angles.

SUMMARY OF THE INVENTION

According to the present invention in another aspect, there is provided a node cast as a single integrated piece characterised by a central ring or disc from the circumference of which extends two or more stubs, the axis of the central ring lying generally normal to the axis of each stub.

The weight of nodes in accordance with the invention is also minimised when compared with more conventional cast or fabricated nodes by intersecting the stubs onto a disc, preferably of annular construction. The node stubs may be wholly or partly conical or necked in shape at their point of connection with the central ring or disc, the whole then making up a single piece integrated casting. Nodes in accordance with the present invention differ from those proposed previously in that:

(a) the stubs connect to a central ring or disc whose axis is usually normal to the axes of the main stubs.

(b) the stubs need only to reduce in diameter for part of their circumference because they meet at the centre, i.e. the "pinching in" of the diameter need not be uniform around the circumference;

(c) the reduction in diameter on any plane towards the node centre may follow an elliptical profile, a circular profile or even a straight sided cone; and (d) variations in stub angle can readily be made during node manufacture by rotating the stub pattern pieces around the central ring pattern form.

In another aspect there is provided a case steel node characterised by a central ring or disc from the external periphery of which project two or more stubs.

BRIEF DESCRIPTION OF THE DRAWINGS

The invention will not be described by way of example only with reference to the accompanying diagrammatic drawings in which.

DETAILED DESCRIPTION OF THE PREFERRED EMBODIMENTS

Figure 1:
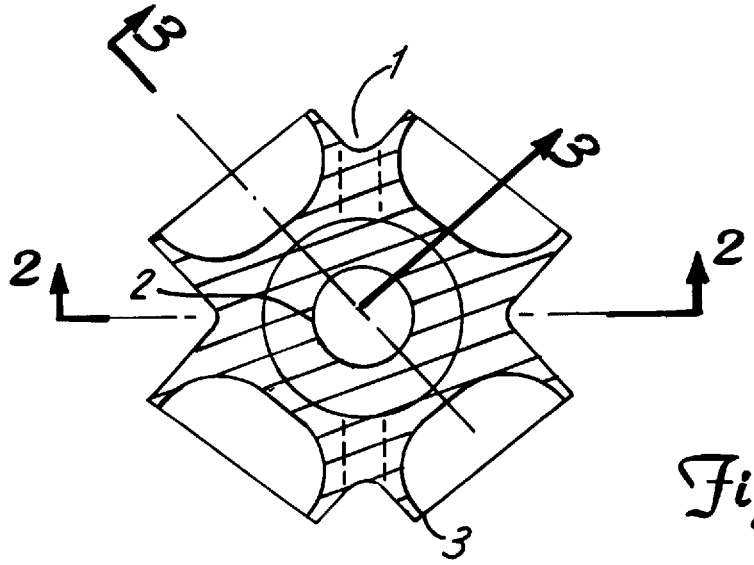
FIG. 1 is a sectional view of a node in accordance with the invention taken along line I—I of FIG. 2.
Figure 2:
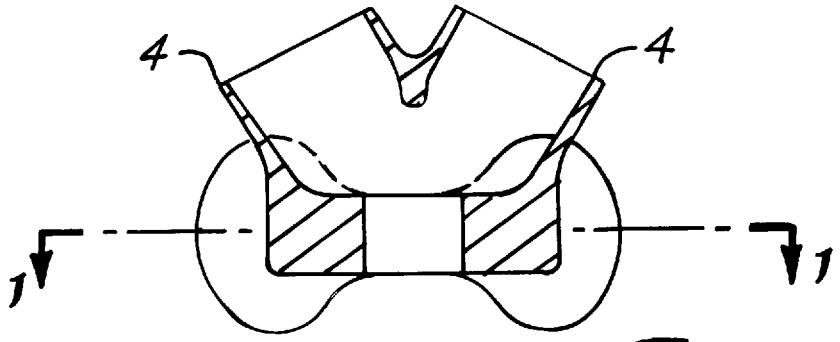
FIG. 2 is a section taken along line II—II of FIG. 1.
Figure 3:
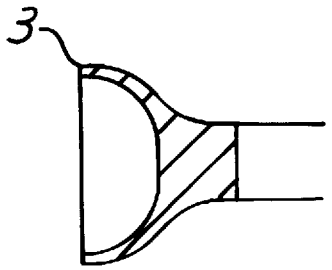
FIG. 3 is a section taken along line III—III of FIG. 1.

The node 1 illustrated in the drawings was produced from a pattern in accordance with the invention and includes a central ring 2 from which protrude four major stubs 3 which lie in a common plane, and where the axis of the ring is normal to the plane of the main members. One or more secondary stubs 4 which lie outside the plane of the ring 2 are additionally provided. Other numbers of major and secondary stubs may be provided. The stubs 3, 4 may either include interconnecting bores to produce savings in weight or may have blind or partially blind bores which together define a rigid diaphragm between the stubs for extra stiffness.

Alternatively, the central ring 2 may include one or more projections lying in directions outside the plane of the ring which can be used for connecting additional members by welding, pinning or the like.

The centre lines of the stubs 3, 4 may all intersect at one point or be variously separated in their intersection points.

As mentioned previously the illustrated node was manufactured from a pattern in accordance with the present invention which includes a standard central ring of the same size and shape as ring 2 and which is suitable for producing a plurality of different node configurations. The stubs of the pattern are of the same shape and size as the stubs 3, 4 and are produced from wood as separate pattern pieces which abut the ring to form the complete piece to be cast. The individual stub pieces are rotatable selectively about the circumference of the central ring to provide for variations in stub angles using the same pieces of pattern equipment.

The stub pattern pieces may be interchanged with ones of differing diameter. In this way, a standard piece of pattern equipment is used to produce nodes having differing stub angles and diameters, thereby greatly reducing pattern making costs.

Once the pattern is assembled, the node is produced by a conventional sand casting technique.

It will be appreciated that the foregoing is merely exemplary of case nodes in accordance with the invention and that modifications can readily be made thereto without departing from the true scope of the invention as set out in the appended claims.

What is claimed is:

1. A pattern from which a steel node can b cast as a single integral piece, the pattern comprising:

a central ring; and a plurality of stubs, each stub being rotatable selectively about the circumference of the central ring to provide for variations in stub spacings and angles whereby a plurality of steel nodes having differing geometries can be produced from the same pattern.

2. The pattern of claim 1 wherein the ring is of circular form.

3. A pattern as claimed in claim 1 wherein the stubs lie in a common plane with the axis of the ring normal to the common plane.

* * * * *

UNITED STATES PATENT AND TRADEMARK OFFICE

CERTIFICATE OF CORRECTION

PATENT NO. : 5,884,686

DATED : MARCH 23, 1999

INVENTOR(S) : ANTHONY WOOD

It is certified that error appears in the above-identified patent and that said Letters Patent is hereby corrected as shown below:

Col. 1, line 12, after "to" insert --cast--

Col. 1, line 25, delete "a node can be cast as a single integral piece", insert --cast nodes can be produced--

Col. 1, line 32, delete "The axis of the ring or disc is generally, but not always normal to the axes of the main stubs".

Col. 1, line 43-47 delete in its entirety "According to the present invention in another aspect, there is provided a node cast as a single integrated piece characterised by a central ring or disc from the circumference of which extends two or more stubs, the axis of the central ring lying generally normal to the axis of each stub.".

Col. 1, line 53, delete "or necked".

Col. 1, line 53, delete "at their point of connection with the central ring or disc", insert --prior to their being connected to the central ring or disc,--

Col. 1, line 59 delete "disc whose axis is usually normal to the axes of the main stubs.", insert --disc;--

Col. 2, line 4, delete "steel".

UNITED STATES PATENT AND TRADEMARK OFFICE

CERTIFICATE OF CORRECTION

PATENT NO. : 5,884,686

DATED : MARCH 23, 1999

INVENTOR(S) : ANTHONY WOOD

It is certified that error appears in the above-identified patent and that said Letters Patent is hereby corrected as shown below:

Col. 2, line 24, delete ", and where the axis of the ring is normal to the plane of the main members"

Col. 3, line 2, after "can", delete "b", insert --be--

Signed and Sealed this

Third Day of October, 2000

*Attest:*

Q. TODD DICKINSON

*Attesting Officer*

*Director of Patents and Trademarks*